United States Patent [19]

Maeda et al.

[11] Patent Number: 4,944,230

[45] Date of Patent: Jul. 31, 1990

[54] CONVEYOR APPARATUS USING AUTOMOTIVE CART

[75] Inventors: Hajime Maeda, Kasugai; Masayuki Tsuneda, Komaki, both of Japan

[73] Assignee: Daifuku Co., Ltd., Japan

[21] Appl. No.: 453,332

[22] Filed: Dec. 18, 1989

Related U.S. Application Data

[63] Continuation of Ser. No. 208,149, Jun. 17, 1988, abandoned.

[30] Foreign Application Priority Data

Aug. 3, 1987 [JP] Japan ..... 62-194118
Nov. 13, 1987 [JP] Japan ..... 62-173524[U]

[51] Int. Cl.[5] ..... B61C 13/00; B61F 13/00; E01B 25/22

[52] U.S. Cl. ..... 104/139; 104/94; 105/29.1

[58] Field of Search ..... 104/88, 94, 139, 140, 104/142, 144; 105/29.1, 29.2; 191/23 R, 23 A

[56] References Cited

U.S. PATENT DOCUMENTS 2,725,973 12/1955 King ..... 191/23 A
3,340,821 9/1967 Wesener ..... 105/29.1 X
3,751,640 8/1973 Daigle et al. ..... 104/88 X
3,855,937 12/1974 Caudill ..... 104/94
4,126,344 11/1978 Vaill ..... 293/4
4,207,821 6/1980 Beckert ..... 105/29.1 X
4,375,193 3/1983 Sullivan ..... 104/118
4,422,384 12/1983 Johnson et al. ..... 105/29.1
4,566,390 1/1986 Pforte ..... 104/88

FOREIGN PATENT DOCUMENTS 2305018 10/1974 Fed. Rep. of Germany ..... 104/94

*Primary Examiner*—Joseph F. Peters, Jr.
*Assistant Examiner*—Virna Lissi Mojica
*Attorney, Agent, or Firm*—Barnes, Kisselle, Raisch, Choate, Whittemore & Hulbert

[57] ABSTRACT

A conveyor apparatus comprising a rail device and automotive carts supported and guided by the rail device to be travelled. The rail device comprises an automotive cart guiding member having a C letter-shaped section provided with an opened portion for travelling the cart therethrough and a duct member communicating with the guiding member through a slit. The cleaning of the inside of the duct member, the installation of various kinds of instrument and the wiring operation within the duct member, the maintenance and inspection after the wiring operation and the like can be carried out through the opened portion and the slit.

2 Claims, 11 Drawing Sheets

CONVEYOR APPARATUS USING AUTOMOTIVE CART

This is a continuation of copending application Ser. No. 07/208,149 filed on June 17, 1988, now abandoned.

SPECIFICATION

1. Field of the Invention

The present invention relates to a conveyor apparatus using an automotive cart used for conveying loads in spaces or factories.

2. Background of the Invention

A conveyor apparatus of this type has been proposed, as in Japanese Utility Model Application Laid-Open No. 58-38627, in which an automotive cart (travelling device) is travelled while supported and guided by a rail device. Said rail device comprises an automotive cart guiding member having a C letter-shaped section formed in rectangular shape and a duct member having a U letter-shaped section disposed so as to be connected with said automotive cart guiding member. A wheel of the cart is engaged with the automotive cart guiding member to carry out the above described support and guide of the cart. The automotive cart guiding member is provided with feeding rails, signal-giving and receiving rails and the like laid therewithin. The automotive cart is provided with current collectors brought into sliding contact with these rails. The duct member is provided with wirings and the like laid therewith, the wirings being connected with the feeding rails.

With the above described conventional type, a disadvantage occurs in that the inner portion of the duct is closed up tight, the constructing operation of wirings and the maintenance and inspection of wirings after the construction being difficult, and increased man-hours being required.

DISCLOSURE OF THE INVENTION

It is an object of the present invention to make various operations to be carried out within a duct member easy.

It is another object of the present invention to propose a rail construction capable of excellently travelling an automotive cart in addition to the achievement of the easy operations.

It is a further object of the present invention to excellently control the travelling of the cart.

In order to achieve these objects, a conveyor apparatus using an automotive cart according to the present invention is provided with a rail device for supporting and guiding said automotive cart, said rail device comprising an automotive cart guiding member having a C letter-shaped section provided with an opened portion for travelling the automotive cart therethrough, a duct member provided so as to be connected with a wall of a side opposite to said opened portion of said automotive cart guiding member and a slit formed so as to pass through said wall for communicating an inside of said duct member with an inside of the automotive cart guiding member.

With such the construction, the cleaning of the inside of the duct member, the installation of various kinds of instrument and the wiring operation in this duct member, the maintenance and inspection after the wiring and the like can be easily carried out through the opened portion and the slit.

In addition, according to the present invention, a pair of guide faces for guiding a frictional driving wheel means for driving the automotive cart are formed at symmetrical positions with a center of the rail device. Thus, the rail device can be easily laid without taking a direction thereof and the like into consideration.

The respective guide faces can be adapted to be capable of being removably fixed thereto a rack engaged with a pinion for travelling the cart. Thus, only any one of the guide faces can be used for guiding the frictional driving wheel means. And, at the places where the rail device is arranged in the vertical or inclined condition, the rack can be mounted on the other guide face, which is not used for the frictional driving wheel means, to travel the automotive cart without hindrance.

According to the present invention, the feeding rails for feeding the automotive cart with an electric power can be mounted on an edge and portion for forming the slit of the automotive cart guiding member by utilizing an inserted structure. With such the construction, the installation of the feeding rail on the rail device and the removal of the feeding rail from the rail device can be easily carried out.

In addition, according to the present invention, the automotive cart is provided with a bumper, and a means for emitting a stop signal for the cart when bumpers of two carts are brought into contact with each other is provided. With such the construction, not only the shock, which is produced when the carts come into collision with each other, can be absorbed by the bumper but also the following cart can be easily stopped when it comes into collision with the preceding cart.

In addition, according to the present invention, an information-recording medium can be mounted on the automotive cart. Thus, the travelling of the cart can be easily and surely controlled. An ID card is suitably used as the information-recording medium.

DESCRIPTION OF THE PREFERRED EMBODIMENTS

Figure 1:
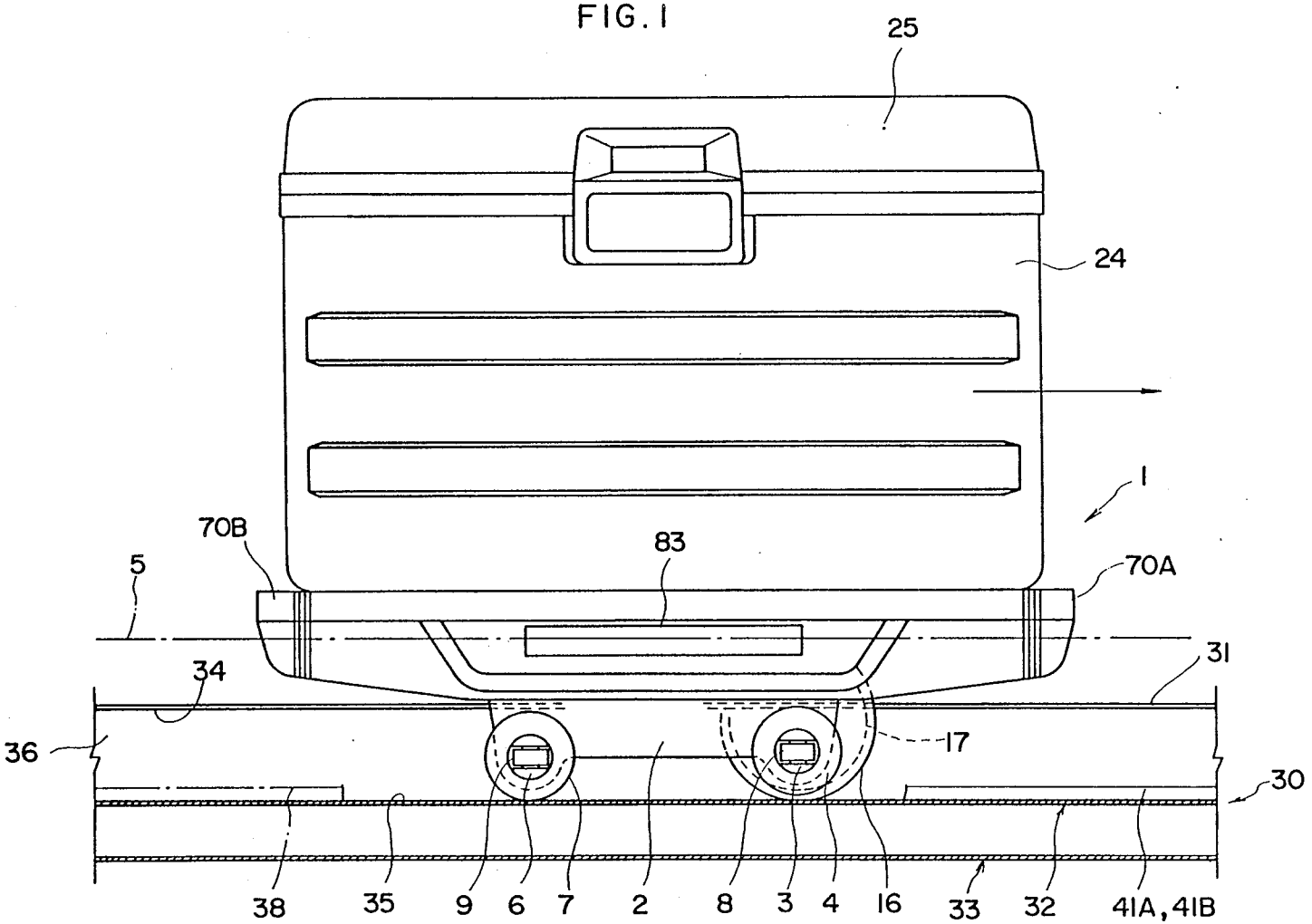
FIG. 1 is a general view showing an automotive cart according to a first embodiment of an apparatus of the present invention.

One preferred embodiment of the present invention will be below described with reference to the drawings.

Reference numeral 1 designates an automotive cart of which body comprises a pair of right and left first wheels 4 idly mounted on a body frame 2 through a first axle 3, a pair of right and left second wheels 7 idly mounted on the body frame 2 through a second axle 6 at positions separated from said first wheel 4 in any one of directions along a predetermined course 5 and side movement-controlling wheels 8, 9 mounted on outer end portions of both wheels 3, 6. A motor 10 is disposed in the box-like body frame 2 provided with at least a lower surface opened, said motor 10 being mounted on a middle portion of the body frame 2 in the front and rear direction thereof through a side pin 11 so as to swing up and down. The front portion of the motor 10 is swingably energized downward by means of a spring 12 disposed between the motor 10 and the body frame 2. Reference numeral 13 designates a stopper for controlling a swinging quantity of the motor 10 against the spring 12. A reduction device 14 is connected with the front portion of the motor 10 in an interlocked manner, a propelling rotary wheel (frictional rotary wheel) 16 positioned adjacent to the first wheel 4 being fixedly mounted on one end of a driving shaft 15 extending in the right and left direction from the reduction device 14, and a pinion gear 17 being fixedly mounted on the other end of the driving shaft 15. The propelling rotary wheel 16 and the pinion gear 17 are disposed at a substantially equal distance from a center 22 of the automotive cart. A pair of right and left current collectors 18A, 18B are disposed on said body frame 2 through a supporting means 23 formed of a plate spring and current collecting positions of these current collectors 18A, 18B are adjacent to the second wheel 7. The body frame 2 is provided with a first and second sensor (stop signal receiver) 19, 20 mounted on a front end and rear end thereof, respectively, therebelow and a permanent magnet (automotive cart signal transmitter) 21 mounted on a middle portion thereof. These sensors 19, 20 and the permanent magnet 21 are positioned in a central portion in the direction of width of the cart. The body frame 2 is provided with a load housing portion 24 mounted on the upper side thereof, said load housing portion 24 having a closing cover member 25.

Figure 10:
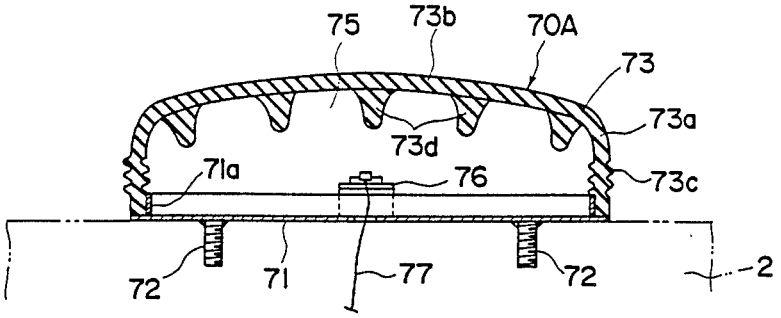
FIGS. 10 to 12 are sectional views showing a sectional view of a bumper according to the present invention and an action of the bumper.
Figure 11:
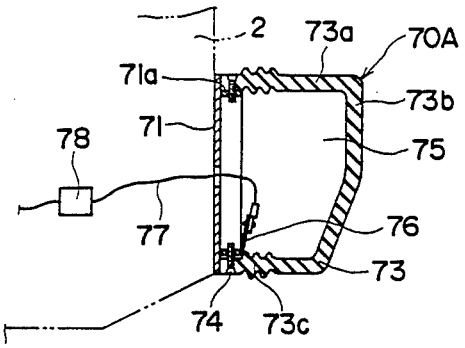
Figure 12:
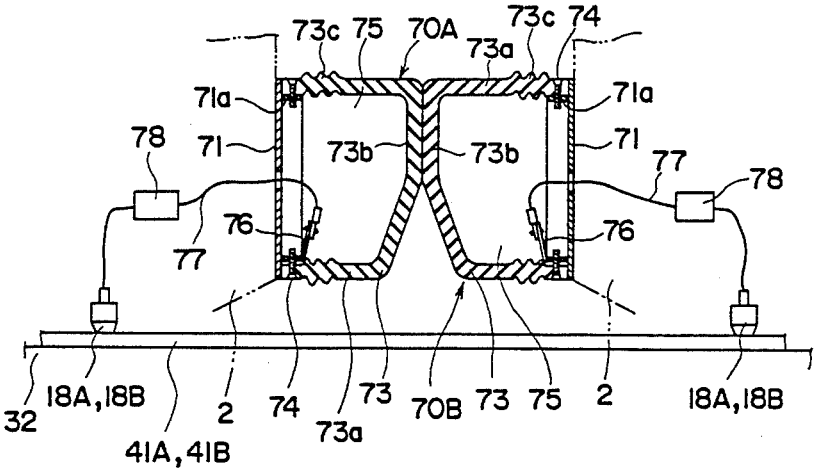

The body frame 2 is provided with bumpers 70A, 70B mounted on the front portion and the rear portion thereof. These bumpers 70A, 70B comprise a fitting member 71 formed of rectangular flat plate-like insulating synthetic resin as a base plate, as shown in FIGS. 10 to 12, said fitting member 71 being removably mounted on the body frame 2 through a plurality of bolts 72 projected from a rear surface thereof. The fitting member 71 is provided with a flexible cover 73 made of electrically conductive rubber and removably mounted on a surface thereof by means of a screw 74 and the like put on a circumferential edge portion **71*a* thereof. The flexible cover 73 comprises a surrounding wall portion 73*a* fixedly put on the fitting member 71 and an arched front plate member 73*b* positioned in front of said fitting member 71 with a space 75 therebetween. A bellows portion 73*c* is formed all over the circumference of the surrounding wall portion 73*a* and a plurality of ribs 73*d* are provided on an inner surface of the front plate member 73*b* in the up and down direction to maintain the configuration if necessary. A connecting terminal 76 is mounted on the surrounding wall portion 73*a* of the flexible cover 73 between the flexible cover 73 and the circumferential edge portion 71*a* of the fitting member 71 in the space 75 within the flexible cover 73. A lead wire 77 extending from the connecting terminal 76 of the bumper 70A of one automotive cart is connected with the current collector 18A and provided with a stop signal transmitting device 78 for the middle portion thereof. A lead wire 77 extending from the connecting terminal 76 of the bumper 70B of another automotive cart is connected likewise with the current collector 18B. When the bumpers 70A, 70B of two automotive carts come into collision with each other, as shown in FIG. 12, an electric current passes between both carts 1 through the flexible covers 73, 73 of both bumpers 70A, 70B brought into contact, whereby the stop signal-transmitting device 78** is operated.

Figure 2:
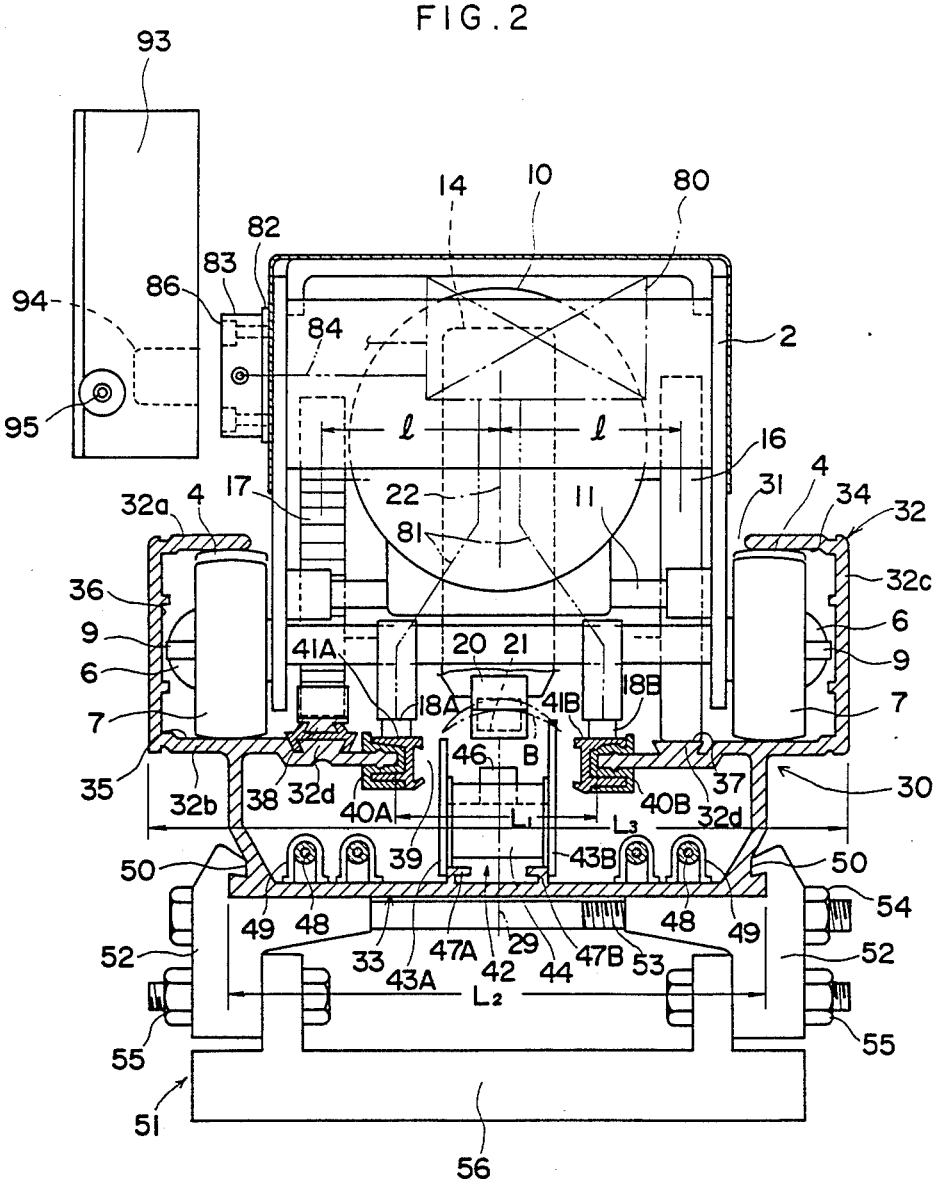
FIG. 2 is a cross section showing main portion of the automotive cart shown in FIG. 1 together with a sectional construction of a rail device.
Figure 3:
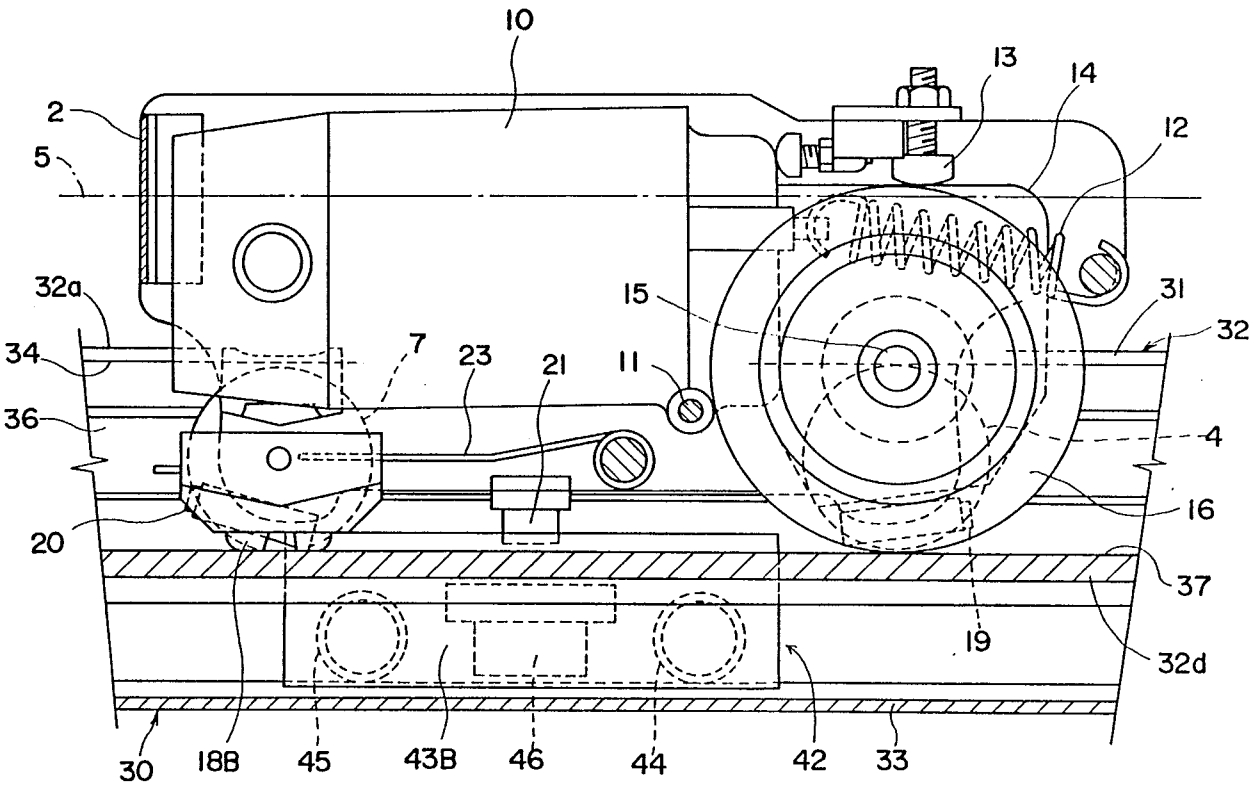
FIG. 3 is a front view showing the automotive cart and the rail device shown in FIG. 2.
Figure 4:
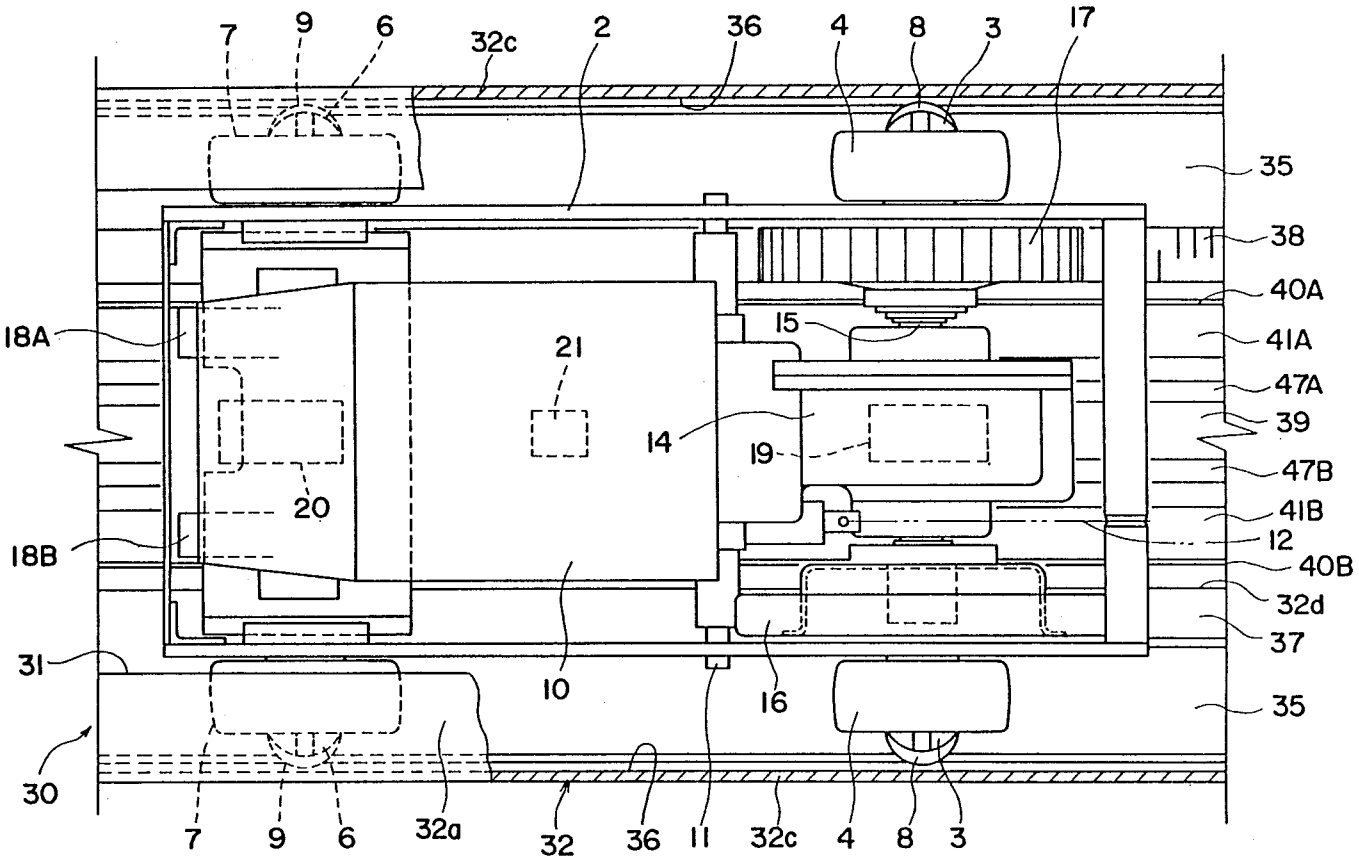
FIG. 4 is a plan view showing the automotive cart and the rail device shown in FIG. 3.
Figure 15:
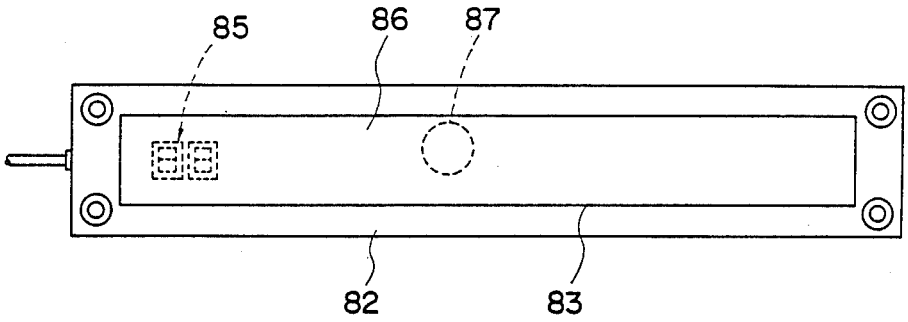
FIG. 15 is a schematic drawing showing an ID card according to the present invention.

As shown in FIGS. 1, 2 and 15, the cart 1 is provided with an optical ID card connected with the current collectors 18A, 18B. A control box 80 is disposed in the body frame 2, said control box 80 being connected with the current collectors 18A, 18B through a lead wire 81. The body frame 2 is provided with the ID card 83 on one side surface thereof through a fitting plate 82, said ID card 83 being connected with the control box 80 through a lead wire 84. The ID card 83 is provided with a display device 85 in a transmitting window 86, the device 85 being capable of carrying out a plurality of displays, that is, a display of cart number of the automotive cart, display of destination, display of the absence or presence of load and the like. Furthermore, the ID card 83 is provided with a lithium cell 87 for using when the current is cut off.

Referring to FIGS. 1 to 6, reference numeral 30 designates a rail device, which is formed symmetrically right and left, for supporting and guiding the cart 1 and comprises an automotive cart guiding member 32 having a C letter-shaped section provided with an opened portion 31 for travelling the cart therethrough formed all over the one surface thereof and a U letter-like duct member 33 connected with an outside of the other surface of said automotive cart guiding member 32. For example, the automotive cart guiding member 32 with the opened portion 31 turned upward comprises one plate members **32*a* provided with first guide surfaces 34 positioned on both sides of the opened portion 31 and engageable with an upper portion of a first wheel 4, the other plate member 32*b* provided with a second guide surface 35 opposite to said plate members 32*a* and engageable with a lower portion of a second wheel 7 and side plate members 32*c* provided with a third guide surface 36 connecting outer ends of both plate members 32*a*, 32*b* with each other and engageable with outer portions of side movement-controlling wheels 8, 9**.

The other plate member **32*b* is provided with a slit 39, for disposing instruments on the rail side, formed in a central portion thereof all over the length thereof, the automotive cart guiding member 32 being communicated with the duct member 33 through this slit 39. The plate member 32*b* is provided with inverted trapezoid-shaped and convexly striped rack-mounting members 32*d* formed on an inner surface side thereof on both sides of the slit 39 so that the inner surface of these rack-mounting members 32***d* may serve as frictional tumbling surfaces 37 engageable with a lower portion of the propelling rotary wheel 16. A rack 38, which is engaged with the pinion gear 17 in an inclined course, a vertical course and the like, is mounted on any one of both rack-mounting members 32*d* by inserting and the like. Such the rail device 30 is formed symmetrically right and left relatively to a rail center 29. The width $L_1$ of the slit 39 is adapted to be smaller than that $L_2$ of the duct member 33.

Figure 5:
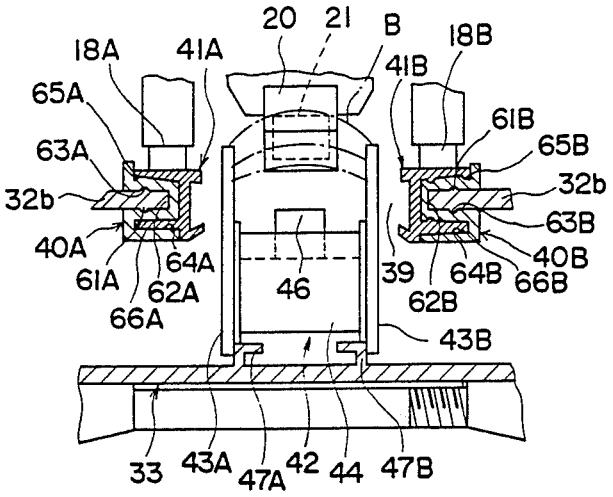
FIG. 5 is a detailed drawing showing feeding rails according to the present invention.
Figure 6:
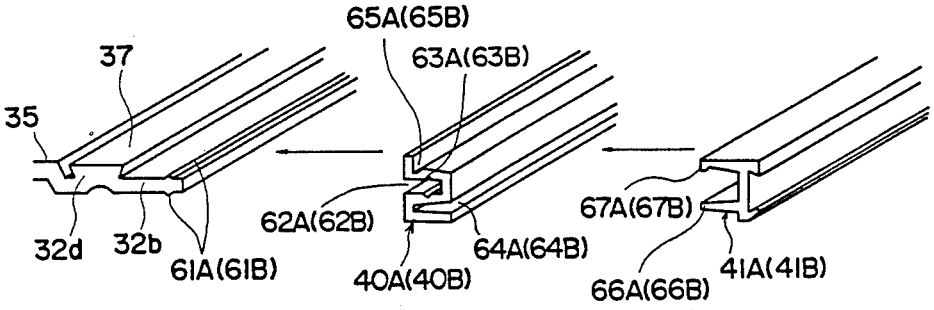
FIG. 6 is a perspective view showing an assembling method of the feeding rails shown in FIG. 5.

An edge portion for forming the slit 39 in the automotive cart guiding member 32 is provided with insulating rod members 40A, 40B put thereon. These insulating rod members 40A, 40B are provided with feeding rails 41A, 41B brought into sliding contact with current collectors 18A, 18B. As shown in FIGS. 5 and 6, the other plate member 32*b* provided with the slit 39 is provided with convex first engaging members 61A, 61B formed in the edge portion thereof on both surfaces in the direction of plate thickness all over the length thereof. The insulating rod members 40A, 40B formed of resins are provided with putting-on concave grooves 62A, 62B engageable sideways with the inner edge portion of said other plate member 32*b*. The putting-on concave grooves 62A, 62B are provided with concave groove-like first engaging members 63A, 63B in the direction of plate thickness which are engageable with the first engaging members 61A, 61B formed on both of an upper inner surface and a lower inner surface thereof. The insulating rod members 40A, 40B are provided with insertion grooves 64A, 64B disposed at positions shifted from the putting-on concave grooves 62A, 62B and opened toward an opposite side formed all over the length thereof. Concave groove-like second engaging members 65A, 65B in the direction of plate thickness of the plate member 32*b* are formed on a surface of the side of the opened portion 31 all over the length thereof. The feeding rails 41A, 41B are provided with inserting piece members 66A, 66B insertable sideways into the insertion grooves 64A, 64B, and convex second engaging members 67A, 67B engageable in the direction of plate thickness of the plate member 32*b* with the second engaging members 65A, 65B are formed all over the length of the feeding rails 41A, 41B.

A rail side instrument 42 on the rail side disposed over the slit 39 to the duct 33 comprises for example a pair of right and left magnetic pole plates 43A, 43B, a pair of front and rear coils (stop signal transmitters) 44, 45 disposed between said magnetic pole plates 43A, 43B and a third sensor (automotive cart signal receiver) 46. Both magnetic pole plates 43A, 43B are engaged with projections 47A, 47B formed integrally with the bottom plate member of the duct member 33 at lower ends thereof, whereby positioning the rail side instrument 42. The upper ends of the magnetic pole plates 43A, 43B are basically projected into the automotive cart guiding member 32, as shown in FIG. 5, to be positioned on both sides of the first sensor 19, the second sensor 20 and the permanent magnet 21 which are automotive cart side instruments. In the curved course, the magnetic pole plate 43B positioned in the outer side of the curve is formed low, as shown in for example FIG. 2.

A plurality of wiring 48, which are connected with the feeding rails 41A, 41B or the instruments 42, are housed in the duct member 33. The wiring 48 are disposed on the inner surface of the duct member 33 through fitting members 49.

The width $L_2$ of the duct member 33 is formed to be smaller than that $L_3$ of the automotive cart guiding member 32, so that both side surfaces of the rail device 30 are formed in a stepped shape. The sides of the duct member 33 are provided with concave constructing engaging members 50 formed at ends thereof. A constructing member 51 on the floor side for arranging the opened portion 31 upward comprises a pair of engaging pieces 52 engageable from outside with said engaging members 50, a bolt 53 and a nut 54 for tightly connecting the engaging pieces 52 with each other, a base frame 56 for supporting both engaging pieces 52 through fitting members (bolts and nuts) 55 and the like.

Figure 9:
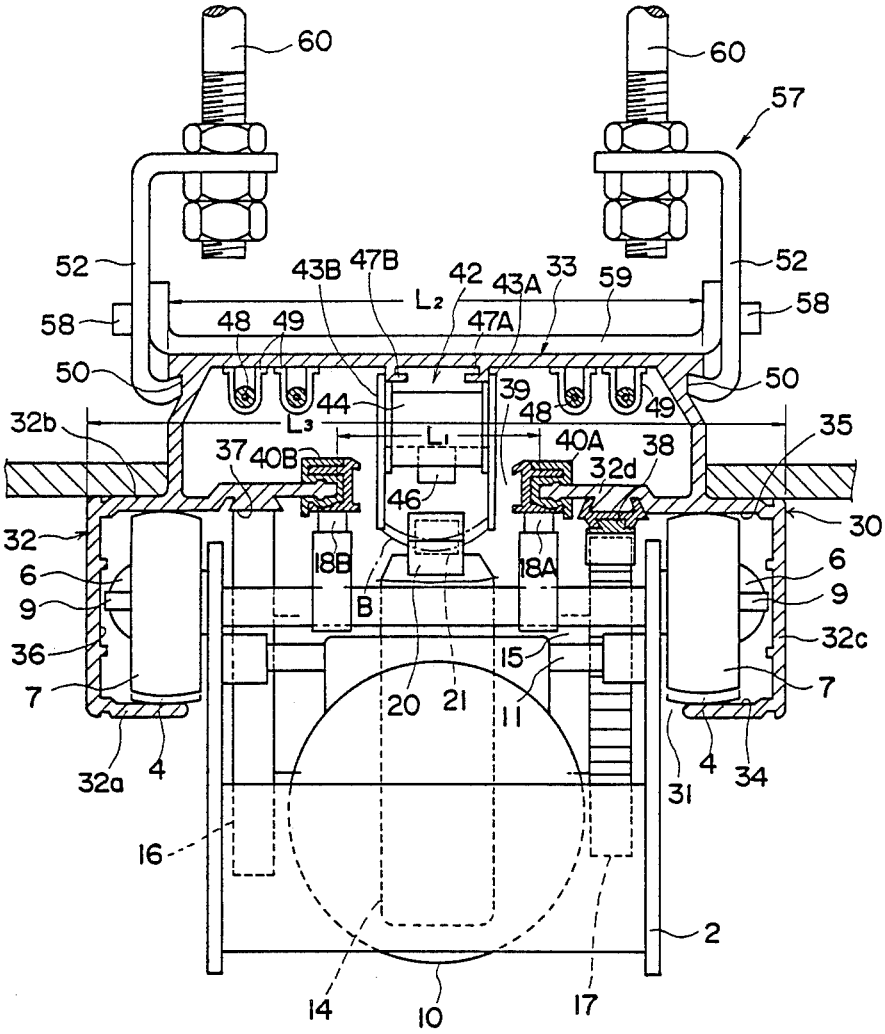
FIG. 9 is a cross section showing an apparatus according to the present invention in the case where the rail device is mounted on a ceiling.

As shown in FIG. 9, a constructing member 57 on the ceiling side for arranging the opened portion 31 downward comprises a pair of engaging pieces 52 engageable from outside with the engaging members 50, a gangway member 59 disposed between the engaging pieces 52 through bolts 58 and hanging rods 60 tightly connected with both engaging pieces 52.

Figure 16:
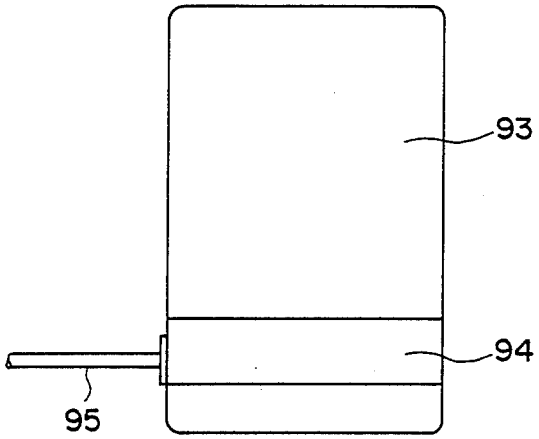
FIG. 16 is a schematic drawing showing a transfer unit for the ID card shown in FIG. 15.
Figure 17:
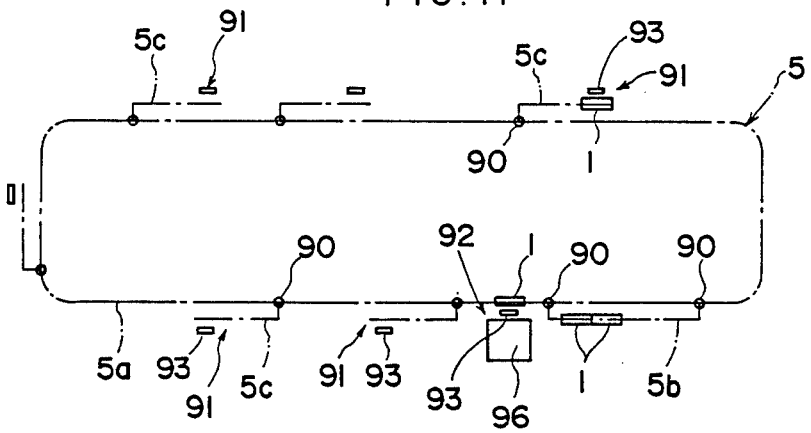
FIG. 17 is a schematic drawing showing one example of a layout of a conveyor apparatus according to the present invention.

The predetermined course 5 comprises, as shown in FIG. 17, for example a circular main course portion 5*a*, a storage portion 5*b* and a branched course portion 5*c* connected with said circular main course portion 5*a* through a branch-junction device 90 and the like, stations 91 being formed in the storage portion 5*b* and the branched course portion 5*c*. The respective stations 91 and a main station 92 are provided with a transfer unit 93 to which the ID card 83 can be disposed opposite. These transfer units 93 comprise a transfer window 94, as shown in FIGS. 2, 16 and 17. Lead wires 95 are connected with a controlling device 96 disposed in the main station 92. The instruments 42 on the rail side are disposed at specified places along the direction of the predetermined course 5. The respective wirings 48 are connected with the controlling device 96.

In the disposition of the rail device 30 through the constructing member 51 on the floor side, the constructing member 57 on the ceiling side and the like, the rail device 30 can be mounted regardless of the right and left direction thereof. The propelling rotary wheel 16 of the automotive cart 1, turning right or left relatively to a center 22 of the automotive cart 1 depending upon the travelling direction of the automotive cart 1, is pressed against any one of frictional tumbling surfaces 37 of both rack-mounting members 32*d* to be tumbled. In the inclined course, the vertical course or the like, the pinion gear 17 is engageable with a rack 38 mounted on a remaining rack-mounting member 32*d* not utilizing the frictional tumbling surface 37.

The travelling operation of the automotive cart 1 in the above described preferred embodiment is below described.

The travelling of the automotive cart 1 is carried out by transmitting a turning force of the motor 10 to the propelling rotary wheel 16 through the reduction device 14 and the driving shaft 15, and pressing the propelling rotary wheel 16 against the frictional tumbling surface 37 to tumble on the surface 37. In this time, the travelling is stably carried out on the predetermined course 5, such as the horizontal course or the inclined course, under the condition of no shaking and the like by the tumbling of the first wheel 4 on the first travelling and guiding surface 34, the tumbling of the second wheel 7 on the second travelling and guiding surface 35 and the tumbling of the side movement-controlling wheels 8, 9 on the third travelling and guiding surface 36. In the ascending and descending inclined course portion or vertical course portion, the travelling without slip can be achieved by engaging the pinion gear 17 with the rack 38.

Figure 7:
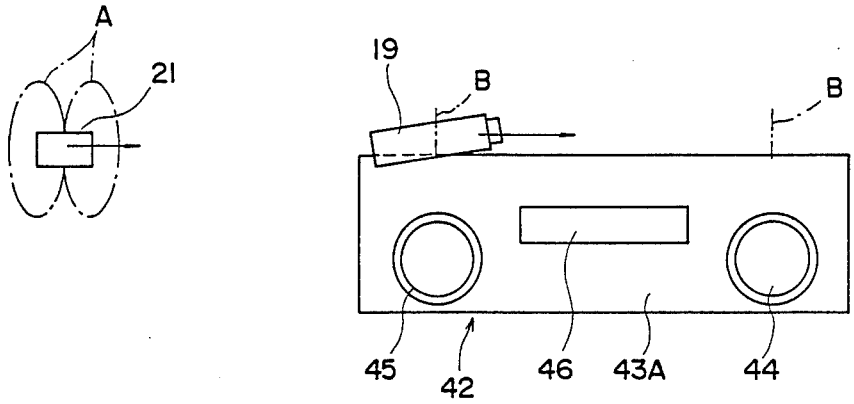
FIGS. 7 and 8 are schematic drawings showing a manner of giving and receiving signals between the rail device and the automotive cart according to the present invention.
Figure 8:
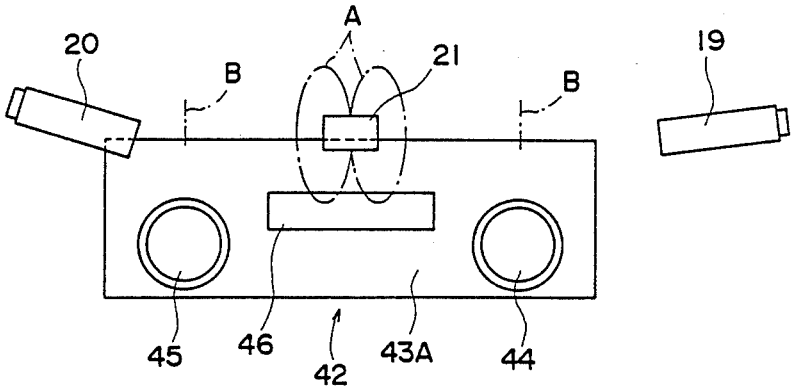

During such the travelling, when the coils 44, 45 are not electrified, the sensors 19, 20 passing through the portion located between both magnetic pole plates 43A, 43B do not receive the stop signal. However, as shown in FIG. 8, it is detected, by detecting a magnetic flux (automotive cart signal) A formed in the upper and lower direction of the permanent magnet 21 by the third sensor 46, that the automotive cart 1 passed the place where the third sensor 46 is disposed (exists in a certain section). The detected signal is given to the controlling device 96 through the wirings 48. In order to stop the specified automotive cart 1 at the specified places (stations) 91, 92 and the like, the colis 44, 45 corresponding to the specified places are electrified before the automotive cart 1 reaches there. Thus, as shown in FIGS. 2, 5 and 7, a magnetic flux (stop signal) B in the right and left direction is formed between the upper ends of both magnetic pole plates 43A, 43B, whereby the sensors 19, 20, which have travelled integrally with the automotive cart 1, detect the magnetic flux B to stop the motor 10 and effect the brake. Thus, the cart 1 is travelled by the braking distance and then stopped. As a result, the permanent magnet 21 is opposite to the sensor 46 to detect the magnetic flux A in the same manner as described above, whereby the confirmation of the stopping is carried out in the controlling device 96.

During the travelling in the curved course the cart 1 is swung outside of the curve by a centrifugal force, whereby also the sensors 19, 20 and the permanent magnet 21 are moved outside. But in this time, as shown in FIG. 2, the outside one of the magnetic pole plates 43A, 43B is formed lower, so that they do not come into collision with each other.

During the travelling of the cart 1, the destination information of the cart 1 is read out in the vicinity of the branch-junction point or the station to judge whether the cart 1 is to be stopped or not. The optical transmission is carried out between the ID card 83 and the transmission unit 93 under the condition that the cart 1 is stopped at the stations 91, 92 on the basis of the obtained judgement. In this time, in the controlling device 96, it can be found by reading out the display of the cart number of the display device 85 that the automotive cart of which cart number is positioned at which station 91. In addition, if necessary, by displaying a load-loadless discriminating number and a destined station number on the display device 85, it is read out and judged by a signal from the ground side whether the automotive cart 1 is loaded or not and where is the destination of the cart 1. Further, when the loading condition is changed in the loading or unloading operation, the writing-in optical signal is given from the transmission unit 93 in correspondence to the change in loading condition to rewrite the ID card 83. The new destination is set for the stopped cart 1 by the writing-in optical signal from the transmission unit 93 and then the cart 1 is started. An electric power collected by the current collectors 18A, 18B is given to the ID card 83 through the control box 80, so that the power source can be easily obtained. During the time when the electricity fails, the information can be prevented from being gone out with the help of the lithium cell 87.

Figure 13:
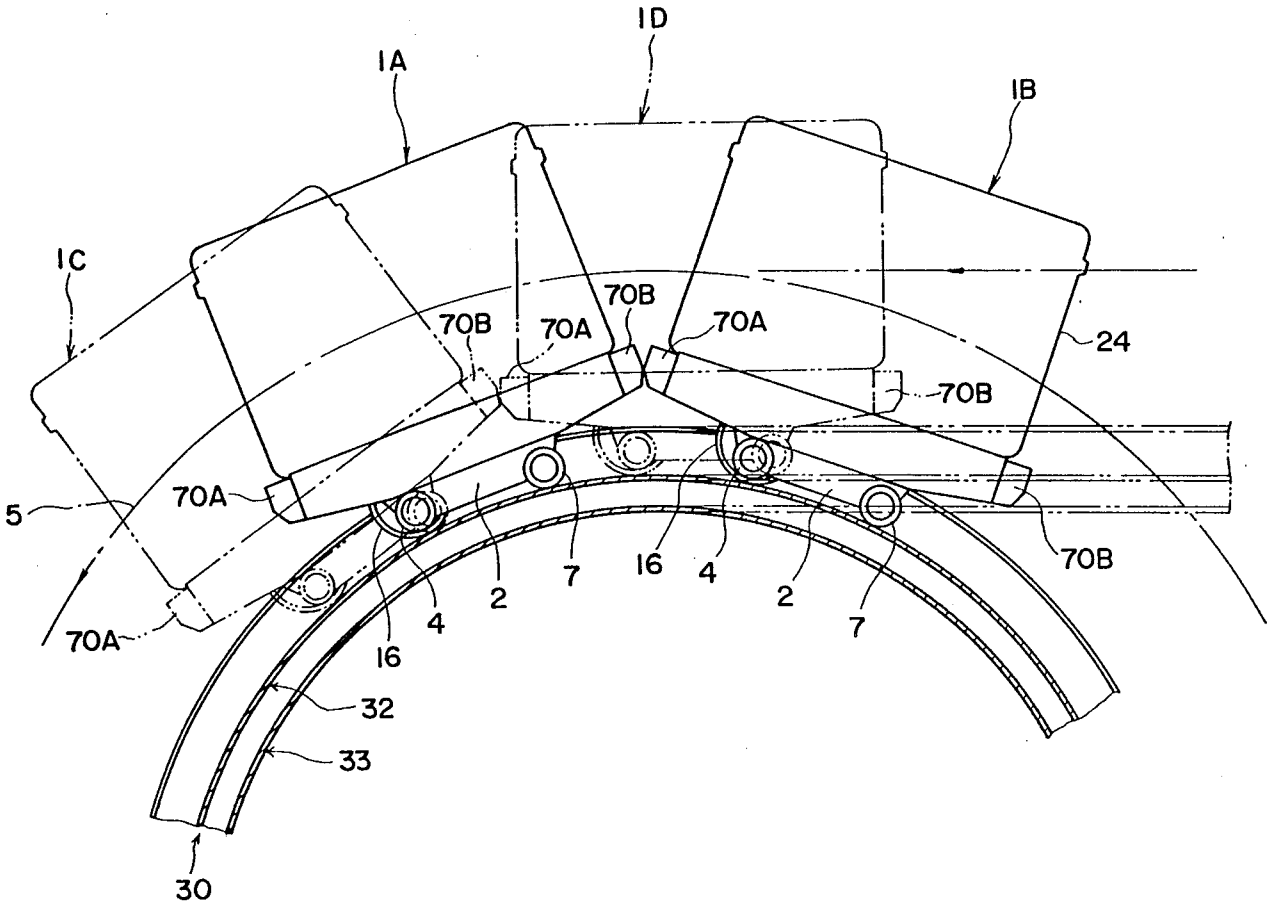
FIGS. 13 and 14 are schematic drawings showing a positional relation between two carts at a place where the rail device is formed in a bent condition.

As shown by for example a full line in FIG. 13, when the preceding automotive cart 1A comes into collision with the following cart 1B under the condition that the former is stopped at the specified place in the course curved in the upper and lower direction, the latter is automatically stopped. When the rear bumper 70B of the preceding cart 1A comes into collision with the front bumper 70A of the following cart 1B, the shock is absorbed by an elastic deformation of the flexible cover 73 of both bumpers 70A, 70B and the deformation of the bellows-like member **73*c* to moderate the shock and prevent both carts 1A, 1B from repeatedly separating from and coming into collision with each other. When the flexible cover 73 of the front bumper 70A of the following cart 1B is brought into contact with the flexible cover 73 of the rear bumper 70B of the preceding cart 1A, a current flows between both carts 1A, 1B through both flexible covers 73, 73 to detect the collision and transmit the stop signal to the following cart 1B by means of the stop signal transmission device 78, whereby the motor 10 is automatically stopped driving and the travelling force is lost to stop the cart 1B. In this time, since the circuit is previously set so that the stop signal transmission device 78 may not take part in the motor 10 of the preceding cart 1A, the desired travelling control of the preceding cart 1A is not affected at all. Subsequently, when the preceding cart 1A is travelled again, the rear bumper 70B of the preceding cart 1A is separated from the front bumper 70A of the following cart 1B to break the electrification therebetween and start to drive the motor 10 of the following cart 1B, whereby also the following cart 1B** is travelled again and then stopped at the specified place.

As shown by the imaginary line in FIG. 13, also in the case where the following cart 1D, which has travelled in the horizontal course portion, comes into collision with the preceding cart 1C stopping at the specified place, the following cart 1D is automatically stopped in the same manner. In addition, also in the plane curved course portion shown in FIG. 14, also in the case where the following cart 1B, which has travelled in the curved course, or the following cart 1D, which has travelled in the straight course portion, comes into collision with the preceding cart 1A stopping at the specified place, these following carts 1B, 1D are automatically stopped in the same manner.

Figure 14:
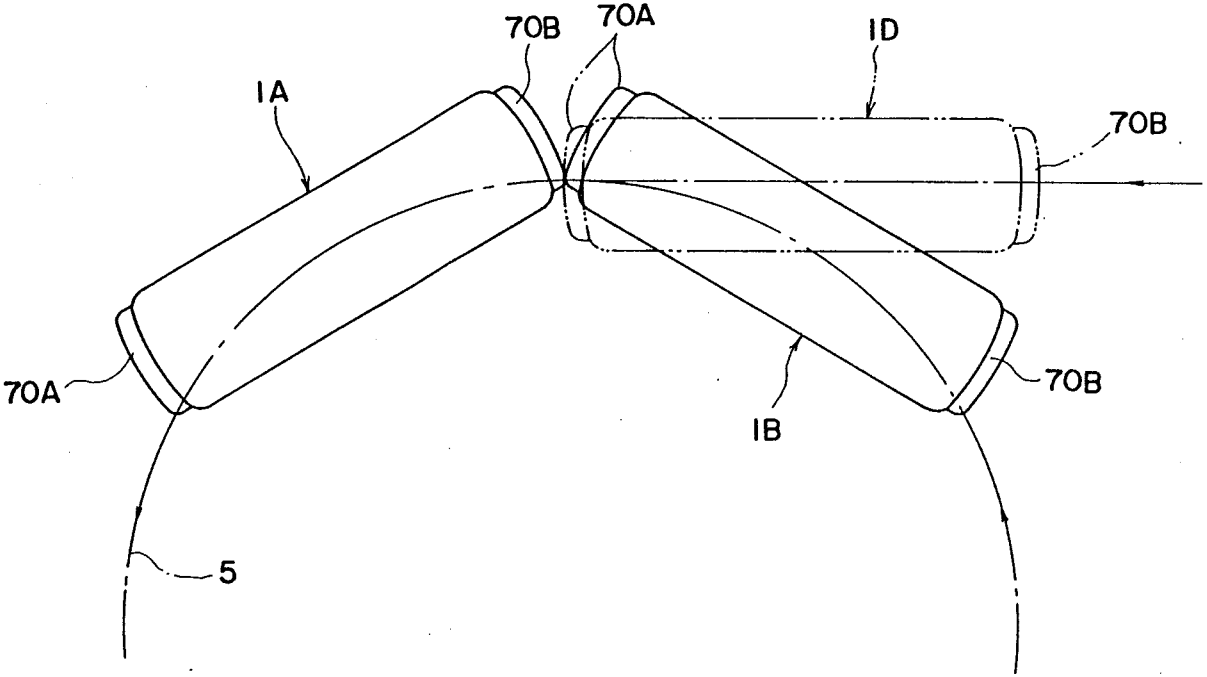

As shown in FIGS. 13 and 14, the following automotive carts 1B, 1D come into collision with the preceding automotive carts 1A, 1C with forming various angles therebetween. But in that time, the rear bumper 70B of the preceding carts 1A, 1C is merely brought into contact with the front bumper 70A of the following carts 1B, 1D by the flexible covers 73 thereof, and the collision force between both carts is absorbed by the bellows-like member **73*c*, so that the carts do not repeat the collision and the separation due to the impetus when came into collision with each other. Even though the preceding carts 1A, 1C are moved forward to some extent, the contact is not lost and the electrification is speedily and surely carried out between the preceding and following carts to automatically stop the following carts 1B, 1D. Accordingly, the following carts 1B, 1D are securely stopped even though the following carts 1B, 1D come into collision with the preceding carts 1A, 1C** in any direction.

In the above described embodiment, the cleaning and the installation of the instruments 42 on the rail side as well as various kinds of wiring operation within the duct member 33, the maintenance and inspection after the wiring, and the inspection, confirmation, replacement and change in arrangement of the instruments 42 on the rail side are carried out through the opened portion 31 and the slit 39. These operation is carried out under the condition that the rail device 30 is installed on the ceiling side by means of the constructing member 57, or on the floor side by means of the constructing member 51.

Although the automotive cart 1 is provided with the sensors 19, 20 mounted on both the front end and the rear end thereof in the above described embodiment, only one sensor may be used. In addition, the use of two sensors leads to the operation of the rear sensor when the overrun of the cart occurs and thus to the satisfactory travelling in both the forward direction and the rearward direction.

Although the instruments 42 on the rail side comprise the coils 44, 45 and the third sensor 46 in the form of one set in the above described embodiment, the third sensor 46 may be disposed in a separated manner.

Furthermore, the feeding rails 41A, 41B may be detachably provided with the insulating cover for opening and closing the slit 39 all over the opposite inner surfaces thereof.

What is claimed is:

1. A conveyor apparatus including an automotive cart and a rail device for supporting and guiding said automotive cart:

said rail device comprising an automotive cart guiding member having a C-shaped section provided with an open portion for the passage of said automotive cart therethrough, a duct member connected to the wall of said guiding member opposite to said open portion thereof, said wall having edge members defining a slit through said wall providing communication between said duct member and said guiding member, feeding rail means mounted on each of said edge members for feeding electric power to said automotive cart, said automotive cart having frictionally propelling rotary wheel means for driving said automotive cart and having pinion drive means, a pair of guide surface means formed on said guiding member on opposite sides of said slit and extending in the direction of length of the rail device, rack means detachably mounted on one of said guide surface means and engageable with said pinion drive means, said feeding rail means comprising an insulating rod member formed of resins and applied on one of said edge members, and a feeding rail applied on said rod member.

2. A conveyor apparatus as set forth in claim 1, wherein:

said one edge member is provided with a first engaging member formed thereon in the direction of thickness thereof, said rod member has a first groove in which said one edge member is received, a second engaging member formed within said first groove and engaging said first engaging member, said rod member having a second groove opening in a direction opposite to said first groove and formed with a third engaging member in the direction of thickness of said one edge member, said feeding rail having an inserting piece inserted in said second groove and a fourth engaging member engaging said third engaging member.

* * * * *